US010304641B2

(12) United States Patent
Watanabe

(10) Patent No.: US 10,304,641 B2
(45) Date of Patent: May 28, 2019

(54) SPRING PLATE AND PUSH SWITCH INCLUDING SPRING PLATE

(71) Applicants: CITIZEN ELECTRONICS CO., LTD., Yamanashi-ken (JP); CITIZEN WATCH CO., LTD., Tokyo (JP)

(72) Inventor: Shinsuke Watanabe, Yamanashi-ken (JP)

(73) Assignees: CITIZEN ELECTRONICS CO., LTD., Yamanashi-ken (JP); CITIZEN WATCH CO., LTD., Tokyo (JP)

( * ) Notice: Subject to any disclaimer, the term of this patent is extended or adjusted under 35 U.S.C. 154(b) by 0 days.

(21) Appl. No.: 15/729,975

(22) Filed: Oct. 11, 2017

(65) Prior Publication Data

US 2018/0108501 A1 Apr. 19, 2018

Related U.S. Application Data

(60) Provisional application No. 62/410,085, filed on Oct. 19, 2016.

(51) Int. Cl.

| | |
|---|---|
| ***H01H 13/48*** | (2006.01) |
| ***H01H 13/14*** | (2006.01) |
| ***H01H 13/50*** | (2006.01) |

(52) U.S. Cl.

CPC ..... *H01H 13/14* (2013.01); *H01H 13/48* (2013.01); *H01H 13/50* (2013.01); *H01H 2215/004* (2013.01); *H01H 2215/006* (2013.01); *H01H 2227/022* (2013.01)

(58) Field of Classification Search

CPC ..... H01H 13/48; H01H 13/36; H01H 13/365; H01H 13/40; H01H 13/42; H01H 2215/036; H01H 2215/004; H01H 2227/022

USPC ..... 200/406, 512; 267/158, 159, 163

See application file for complete search history.

(56) References Cited

U.S. PATENT DOCUMENTS

| | | | | |
|---|---|---|---|---|
| 4,032,739 | A | 6/1977 | Nicolaisen et al. | |
| 4,484,042 | A * | 11/1984 | Matsui | H01H 13/38 200/243 |
| 4,751,351 | A * | 6/1988 | Lambke | H01H 13/50 200/409 |
| 5,269,499 | A * | 12/1993 | Schwab | F16F 1/322 200/290 |
| 6,323,449 | B1 * | 11/2001 | Janniere | H01H 13/12 200/317 |

(Continued)

FOREIGN PATENT DOCUMENTS

| | | |
|---|---|---|
| CN | 2884489 | 3/2007 |

OTHER PUBLICATIONS

Chinese Office Action dated Nov. 7, 2018 in corresponding Chinese Patent Application No. 201710941391.0 with English Translation.

*Primary Examiner* — Vanessa Girardi

(74) *Attorney, Agent, or Firm* — Wenderoth, Lind & Ponack, L.L.P.

(57) ABSTRACT

A spring plate includes a central portion; an opening that is positioned at a center of the central portion; and a strip extending from a part of an inner edge of the opening that is positioned at the center of the central portion. The strip includes a first width that is positioned adjacent to the part of the inner edge of the opening and a second width that is positioned adjacent to an end of the strip. The first width of the strip is wider than the second width that is positioned adjacent to the end of the strip.

13 Claims, 28 Drawing Sheets

(56) References Cited

U.S. PATENT DOCUMENTS

| | | | | |
|---|---|---|---|---|
| 6,756,554 | B1 * | 6/2004 | Hu | H01H 13/48<br>200/406 |
| 7,196,280 | B2 * | 3/2007 | Rochon | H01H 13/36<br>200/406 |
| D817,753 | S * | 5/2018 | Pedley | D8/399 |

* cited by examiner

SPRING PLATE AND PUSH SWITCH INCLUDING SPRING PLATE

CROSS-REFERENCE TO RELATED APPLICATION

The present application claims benefit of U.S. provisional application No. 62/410,085 filed on Oct. 19, 2016, the disclosures of which are incorporated herein by reference in its entirety.

BACKGROUND

Field

The subject matter herein generally relates to a spring plate, and a push switch including the spring plate. Various electronic devices include push switches. Various electronic devices may be computers, portable communication devices, wearable devices, and game consoles, on-vehicle devices for example.

Discussion of the Background

It is open to the public that a conventional electrical type contact switch includes a leaf spring received in a slot and extending transversely through walls. A leaf spring disposed in the slot has a resiliently hinged flap extending at an acute angle relative to the plane of the spring. The flap is in resilient biasing engagement with the inclined surfaces of the contact carrier. The flap is of trapezium shape and is an integral part of the spring. (For reference, see U.S. Pat. No. 4,032,739).

SUMMARY

In a first aspect of the subject matter of the present application, a spring plate includes a central portion; an opening that is positioned at a center of the central portion; and a strip extending from a part of an inner edge of the opening that is positioned at the center of the central portion. The strip includes a first width that is positioned adjacent to the part of the inner edge of the opening and a second width that is positioned adjacent to an end of the strip. The first width of the strip is wider than the second width that is positioned adjacent to the end of the strip.

In a second aspect of the subject matter of the present application, a spring plate includes a central portion; an opening that is positioned at a center of the central portion; a first strip extending from a first part of an inner edge of the opening that is positioned at the center of the central portion; and a second strip extending from a second part of the inner edge of the opening that is positioned at the center of the central portion. The first strip includes a first width that is positioned adjacent to the first part of the inner edge of the opening and a second width that is positioned adjacent to an end of the first strip. The first width of the first strip is wider than the second width that is positioned adjacent to the end of the first strip. The second strip includes a first width that is positioned adjacent to the second part of the inner edge of the opening and the second width that is positioned adjacent to an end of the second strip. The first width of the second strip is wider than the second width that is positioned adjacent to the end of the second strip.

In a third aspect of the subject matter of the present application, a spring plate includes a central portion; an opening that is positioned at a center of the central portion; a strip including a first end that is connected to a first part of an inner edge of the opening and a second end that is connected to a second part of the inner edge of the opening. The strip crosses the opening to divide the opening into two openings.

In a fourth aspect of the subject matter of the present application, a spring plate includes a central portion; an opening that is positioned at a center of the central portion; a first strip extending from a first part of an inner edge of the opening that is positioned at the center of the central portion to an end of the first strip; a second strip extending from a second part of the inner edge of the opening that is positioned at the center of the central portion to an end of the second strip; and a third strip extending from a third part of the inner edge of the opening that is positioned at the center of the central portion to an end of the third strip. The end of the first strip, the end of the second strip, and the end of the third strip are positioned adjacent to a center of the opening in plan view, and positioned lower than the inner edge of the opening.

BRIEF DESCRIPTION OF THE DRAWING

FIG. 1D is a schematic view of the spring plate with a strip and the film before a pressing force is applied on the spring plate.

FIG. 1E is a schematic view of the spring plate and the film when a pressing force is being applied on the spring plate to a point that the strip included in the spring plate presses down the film from above such that a second electrode is electrically in contact with a first electrode in the film.

FIG. 1F is a schematic view of the spring plate and the film when a pressing force is being applied on the spring plate to an end position of the spring plate.

DESCRIPTION OF THE EMBODIMENTS

Figure 1A:
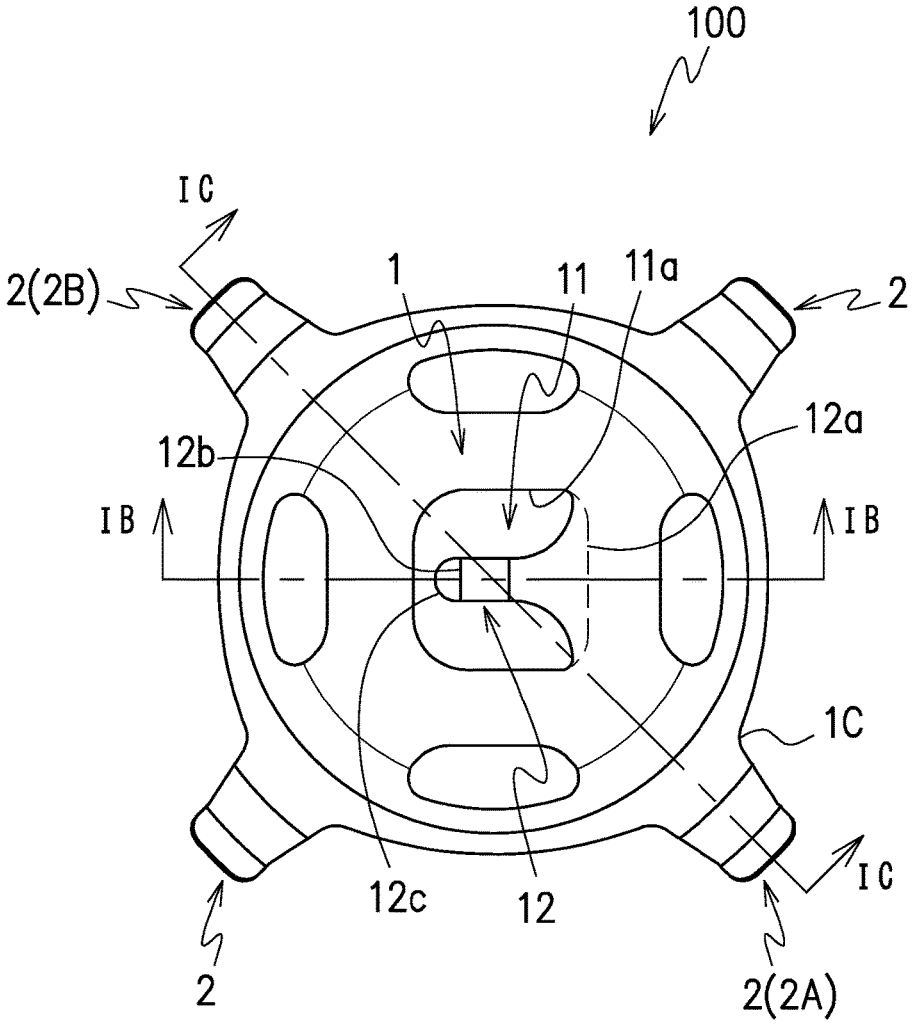
FIG. 1A is a top plan view of a spring plate according to a first embodiment of the subject matter.

As used herein, the term "and/or" includes any and all combinations of one or more of the associated listed items.

The terminology used herein is for the purpose of describing particular embodiments only and is not intended to be limiting of the subject matter. As used herein, the singular forms "a", "an" and "the" are intended to include the plural forms as well, unless the context clearly indicates otherwise.

As illustrated in the figures submitted herewith, some sizes of structures or portions may be exaggerated relative to other structures or portions for illustrative purposes.

Relative terms such as "below" or "above" or "upper" or "lower" or "top" or "bottom" may be used herein to describe a relationship of one element, layer or region to another element, layer or region as illustrated in the figures. It will be understood that these terms are intended to encompass different orientations of a device in addition to the orientation depicted in the figures.

In a first aspect of the subject matter, a spring plate includes a central portion; an opening that is positioned at a center of the central portion; and a strip extending from a part of an inner edge of the opening that is positioned at the center of the central portion of the spring plate. The strip includes a first width that is positioned adjacent to the part of the inner edge of the opening, and the strip includes a second width that is positioned adjacent to an end of the strip. The first width of the strip is wider than the second width that is positioned adjacent to the end of the strip.

In a second aspect of the subject matter, a push switch includes a film that includes a first electrode and a second electrode; and a spring plate including a strip. The strip of the spring plate is configured to endure a first operating load that is greater than a second operating load which the film is configured to endure.

In a third aspect of the subject matter, a spring plate includes a central portion; an opening that is positioned at a center of the central portion; a first strip extending from a first part of an inner edge of the opening that is positioned at the center of the central portion; and a second strip extending from a second part of the inner edge of the opening that is positioned at the center of the central portion. The first strip includes a first width that is positioned adjacent to the first part of the inner edge of the opening and a second width that is positioned adjacent to an end of the first strip. The first width of the first strip is wider than the second width that is positioned adjacent to the end of the first strip. The second strip includes a first width that is positioned adjacent to the second part of the inner edge of the opening and the second width that is positioned adjacent to an end of the second strip. The first width of the second strip is wider than the second width that is positioned adjacent to the end of the second strip.

Also, it is suggested that the first part and the second part of the inner edge of the opening of the spring plate is positioned at a first side of the opening.

In a fourth aspect of the subject matter, a spring plate includes a central portion; an opening that is positioned at a center of the central portion; a strip including a first end that is connected to a first part of an inner edge of the opening and a second end that is connected to a second part of the inner edge of the opening. The strip crossing the opening is configured to divide the opening into two openings.

Also, it is suggested that the first end of the strip is positioned opposite to the second end of the strip.

Furthermore, it is suggested that the strip including a central portion that is positioned lower than the opening.

In a fifth aspect of the subject matter, a spring plate includes a central portion; an opening that is positioned at a center of the central portion; a first strip extending from a first part of an inner edge of the opening that is positioned at the center of the central portion to an end of the first strip; a second strip extending from a second part of the inner edge of the opening that is positioned at the center of the central portion to an end of the second strip; and a third strip extending from a third part of the inner edge of the opening that is positioned at the center of the central portion to an end of the third strip. The end of the first strip, the end of the second strip, and the end of the third strip are positioned adjacent to a center of the opening in a plan view. The end of the first strip, the end of the second strip, and the end of the third strip are positioned lower than the inner edge of the opening.

Also, it is suggested that the first strip may include a curving portion, the second strip may include a curving portion, and the third strip may include a curving portion.

Furthermore, it is suggested that the spring plate may include a central connection that is positioned at the center of the opening in a plan view. The central connection may be positioned lower than the inner edge of the opening. The end of the first strip, the end of the second strip and the end of the third strip may be connected to the central connection.

Embodiments of the subject matter now will be described more hereinafter with reference to the accompanying figures. This subject matter may, however, be embodied in many different forms and should not be construed as limited to the embodiments set forth herein. Rather, these embodiments are provided so that this disclosure will be thorough and complete, and will fully convey the scope of the subject matter to those skilled in the art.

A spring plate 100 according to a first embodiment of the present application will be described with reference to FIGS. 1A-1C.

The spring plate 100 includes a central portion 1; an opening 11 that is positioned at a center of the central portion 1; and a strip 12 extending from a part of an inner edge 11*a* of the opening 11 that is positioned at the center of the central portion 1 of the spring plate 100. The strip 12 includes a first width 12*a* that is positioned adjacent to the part of the inner edge 11*a* of the opening 11 and a second width 12*b* that is positioned adjacent to an end 12*c* of the strip 12. The first width 12*a* of the strip 12 is wider than the second width 12*b* that is positioned adjacent to the end 12*c* of the strip 12.

The first width 12*a* of the strip 12 may be in a range of one fourth to one third of a length of the inner edge 11*a* of the opening 11.

The spring plate 100 may be made of stainless, for example. The spring plate 100 may be made of alloy steel, nickel alloy, aluminum alloy, and/or titanium, for example.

The spring plate 100 may be cut out from a metal plate. The outline of the spring plate 100 including the strip 12 and leg portions 2 may be a cross section of the spring plate that is made of metal.

The strip 12 includes a first shape that spreads toward the first width 12*a* from a position that is closer to the first width 12*a* than the end 12*c* of the strip 12. This configuration of the spring plate 100 enables to lessen stress that may be generated at a root of the strip 12 while a pressing force is being applied on the spring plate 100. The first width 12*a* is a width at the root of the strip 12.

The strip 12 further includes a second shape that is an elongated shape. The elongated shape is positioned closer to the end 12*c* of the strip 12 than the root with the first width 12*a* of the strip 12. In this embodiment, the end 12*c* of the strip 12 of the spring plate 100 is not connected to a part of the spring plate 100, and thus, the end 12*c* of the strip 12 is free.

In this embodiment, since the end 12*c* of the strip 12 of the spring plate 100 is free, a switch stroke would be secured even when a pressing force is being applied on the spring plate to an end position of the spring plate.

The first shape of the strip 12 may curvedly spread toward the first width 12*a* of the strip 12 in a plan view as in FIG. 1A.

As noted above, the spring plate 100 may include a the leg portion 2 projecting outward from an outer edge 1*c* of the central portion 1 of the spring plate 100. In this embodiment, the central portion 1 of the spring plate 100 may include a circular outline. For more details, in this embodiment, the spring plate 100 may include a first leg portion 2(2A) projecting outward from the edge 1*c* of the central portion 1. The spring plate 100 further may include a second leg portion 2 (2B) projecting outward from the edge 1*c* of the central portion 1. The first leg portion 2(2A) may be positioned with a space from the second leg portion 2(2B). The first leg portion 2(2A) may be positioned at an opposite side of the second leg portion 2(2B).

As in FIG. 1A, the spring plate 100 may include four leg portions 2 positioned with a space to one another of the leg portions 2 around the central portion 1. The four leg portions 2 project outward and downward from the outer edge 1*c* of the central portion 1 of the spring plate 100.

Also, the central portion 1 of the spring plate 100 may include a convex shape around the opening 11.

Figure 1B:
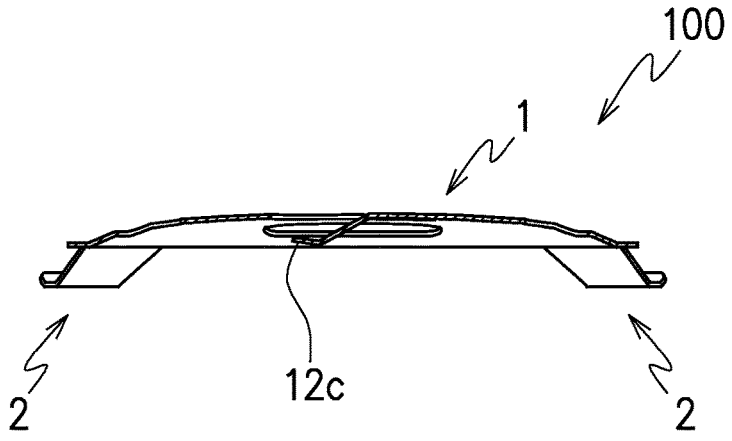
FIG. 1B is a cross-sectional view of the spring plate, taken along a dotted line IB of FIG. 1A. The dotted line IB is a first direction in FIG. 1A.
Figure 1C:
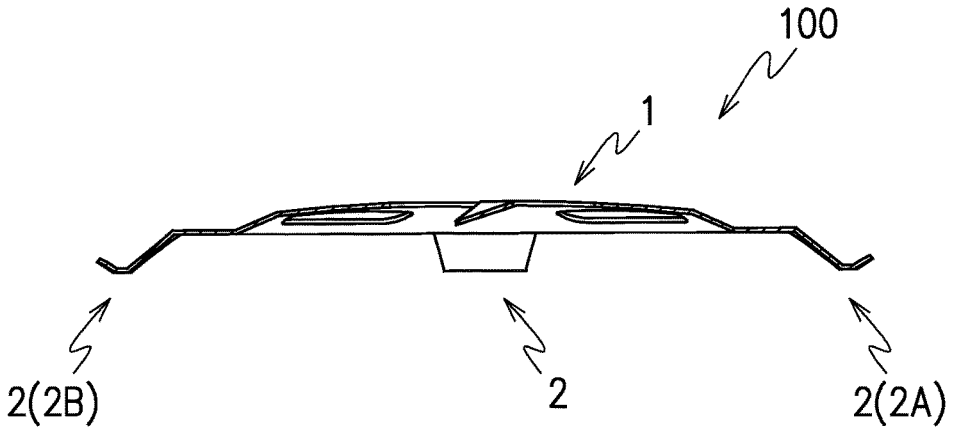
FIG. 1C is a cross-sectional view of the spring plate, taken along a dotted line IC of FIG. 1A. The dotted line IC is a second direction in FIG. 1A.

FIG. 1B is a cross-sectional view of the spring plate 100, taken along a dotted line IB of FIG. 1A.

As in FIG. 1B, for example, the end 12*c* of the strip 12 is positioned lower than the inner edge 11*a* of the opening 11. The strip 12 of the spring plate 100 may be configured to endure an operating load that is 60 gf/mm or more.

For example, the strip 12 of the spring plate 100 is configured to endure an operating load that is in a range of 60 gf/mm or more to 400 gf/mm or less.

Figure 1D:
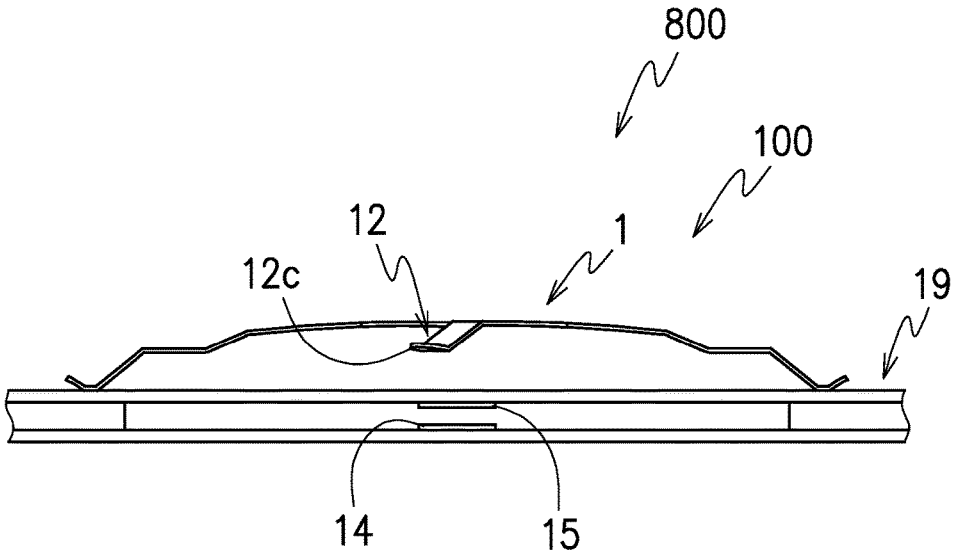
FIG. 1D to FIG. 1F are schematic views of changes of shapes of a spring plate according to an embodiment of the subject matter when a pressing force is being applied on the spring plate from above. A film is included in a switch.
Figure 1E:
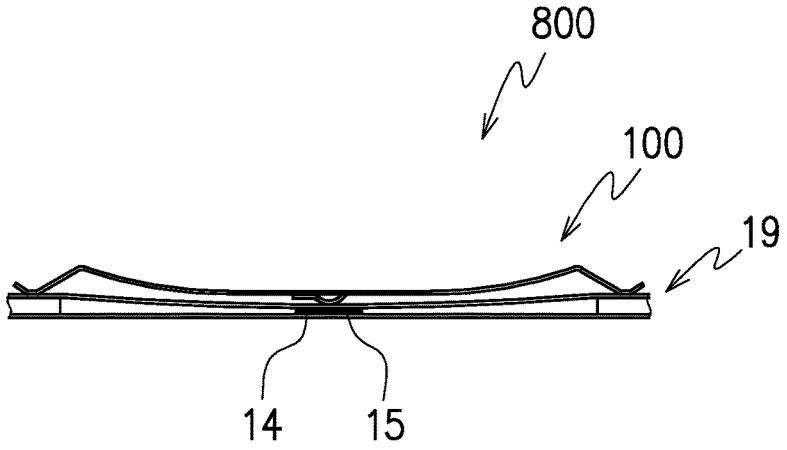
Figure 1F:
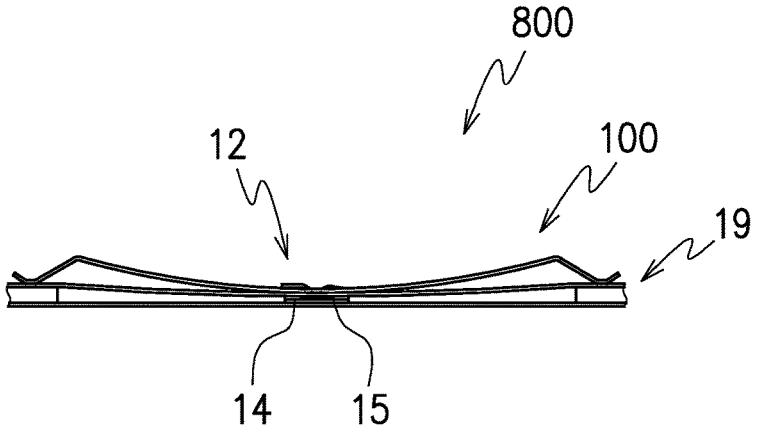

FIG. 1D to FIG. 1F are schematic views showing changes of shapes of a spring plate 100 according to an embodiment of the subject matter and a film 19 included in a switch 800 when a pressing force is being applied on the spring plate 100 from above.

As in FIG. 1D, the spring plate 100 with a strip 12 and the film 19 before a pressing force is applied on the spring plate 100.

The push switch 800 may include the film 19 and the spring plate 100 including the strip 12 that is arranged above a second electrode 15 of the film 19. As in FIG. 1J, the film 19 includes a first layer 21 that includes an upper surface 21*a* and a lower surface 21*b* opposite to the upper surface 21*a*, a second layer 22 that includes an upper surface 22*a* and a lower surface 22*b* opposite to the upper surface 22*a*, and a third layer 23 that includes an upper surface 23*a* and a lower surface 23*b* opposite to the upper surface 23*a*. The first layer 21 of the film 19 includes a first electrode 14 arranged on the upper surface 21*a* of the first layer 21. The second layer 22 of the film 19 includes a hole 24 passing through the second layer 22 from the upper surface 22*a* to the lower surface 22*b* of the second layer 22. The third layer 23 of the film 19 includes a second electrode 15 arranged on the lower surface 23*b* of the third layer 23. The second electrode 15 arranged on the lower surface 23*b* of the third layer 23 of the film 19, the hole 24 of the second layer 22 of the film 19, and the first electrode 14 arranged on the upper surface 21*a* of the first layer 21 may be positioned below the central portion 1 of the spring plate 100.

FIG. 1E is a schematic view of the spring plate 100 and the film 19 when a pressing force is applied on the spring plate 100 with the strip 12 to press the film 19 from above such that the second electrode 15 arranged on the lower surface 23*b* of the third layer 23 of the film 19 is electrically in contact with the first electrode 14 arranged on the upper surface 21*a* of the first layer 21 of the film 19. As in FIG. 1E, electrical connection is obtained before the push switch is pressed down to an end position.

FIG. 1F is a schematic view showing the spring plate 100 and the film 19 when a pressing force is being applied on the spring plate 100 to an end position of the spring plate 100. At the end position, the concave shape of the central portion 1 of the spring plate 100 is crashed out of the shape.

Figure 1G:
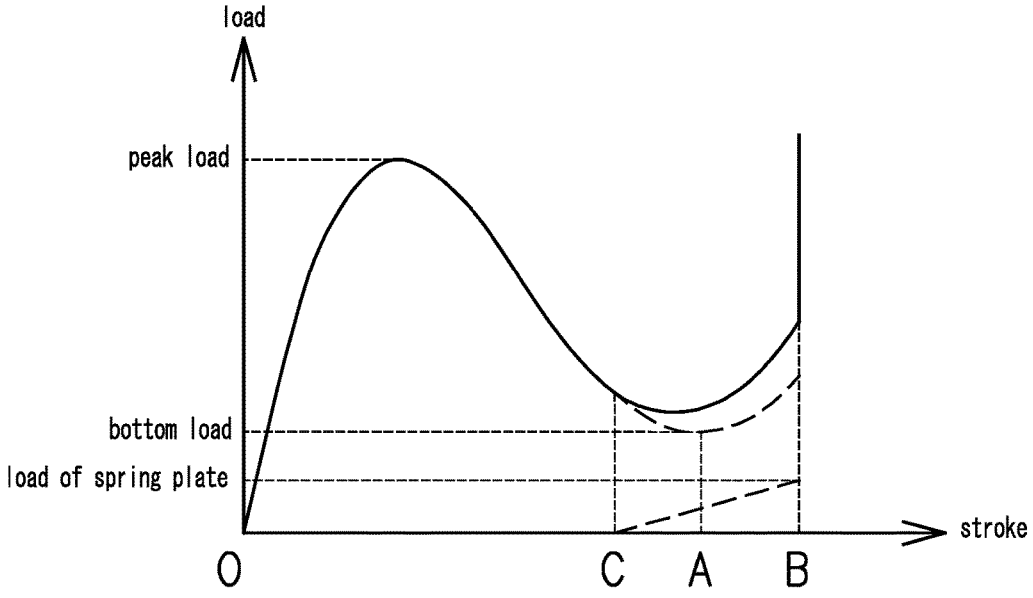
FIG. 1G shows characteristics of a spring plate including a strip according to an embodiment of the subject matter.

FIG. 1G shows characteristics of a spring plate including a strip according to an embodiment of the subject matter.

Figure 1H:
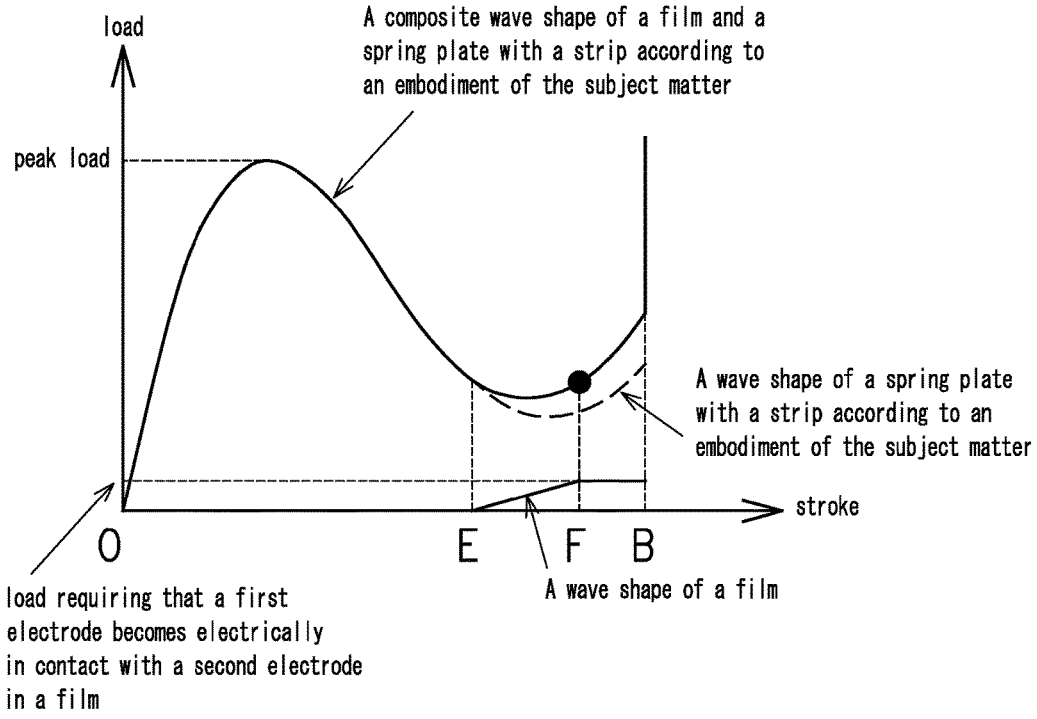
FIG. 1H shows characteristics of a combination of a spring plate including a strip according to an embodiment of the subject matter and a film including a first layer with an upper electrode, a second layer with a hole, and a third layer with a lower electrode.

FIG. 1H shows characteristics of a combination of a spring plate including a strip according to an embodiment of the subject matter and a film including a first layer with an upper electrode, a second layer with a hole, and a third layer with a lower electrode. The first electrode 14 is electrically in contact with the second electrode 15 at the position shown as "F" as shown in FIG. 1E before the end position of the spring plate as shown in FIG. 1F, for example. If a spring plate without a strip adjacent to a center of the spring plate is pressed down, the first electrode would be electrically in contact with the second electrode in the film 19 at the end position of the spring plate.

Figure 1I:
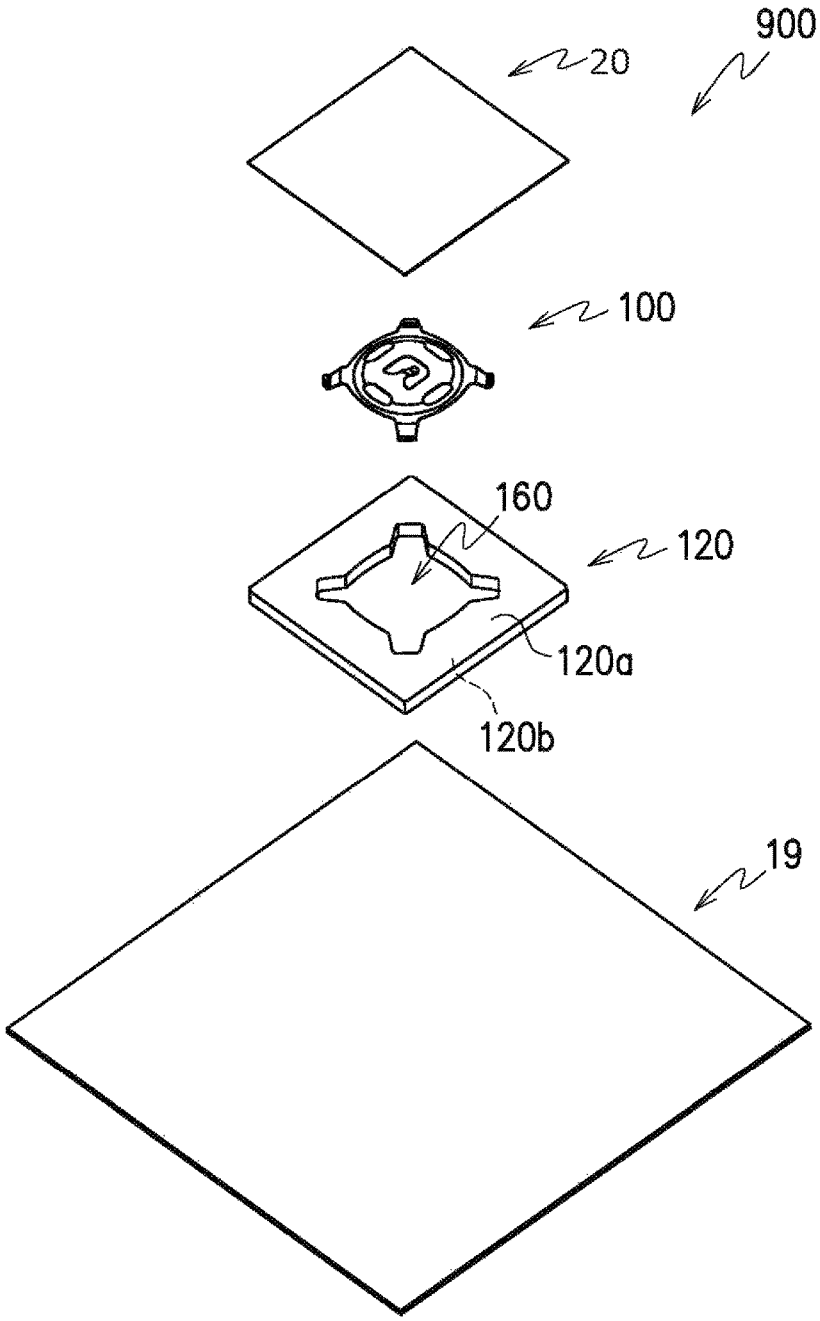
FIG. 1I is an exploded perspective view of a push switch according to an embodiment of the subject matter.

FIG. 1I is an exploded perspective view of a push switch 900 according to an embodiment of the subject matter.

In this embodiment, the push switch 900 may include a spring plate according to an embodiment of the subject matter. For example, the push switch 900 may include the spring plate 100 according to the first embodiment of the subject matter, a protective sheet 20 over the spring plate 100, and the film 19.

Figure 1J:
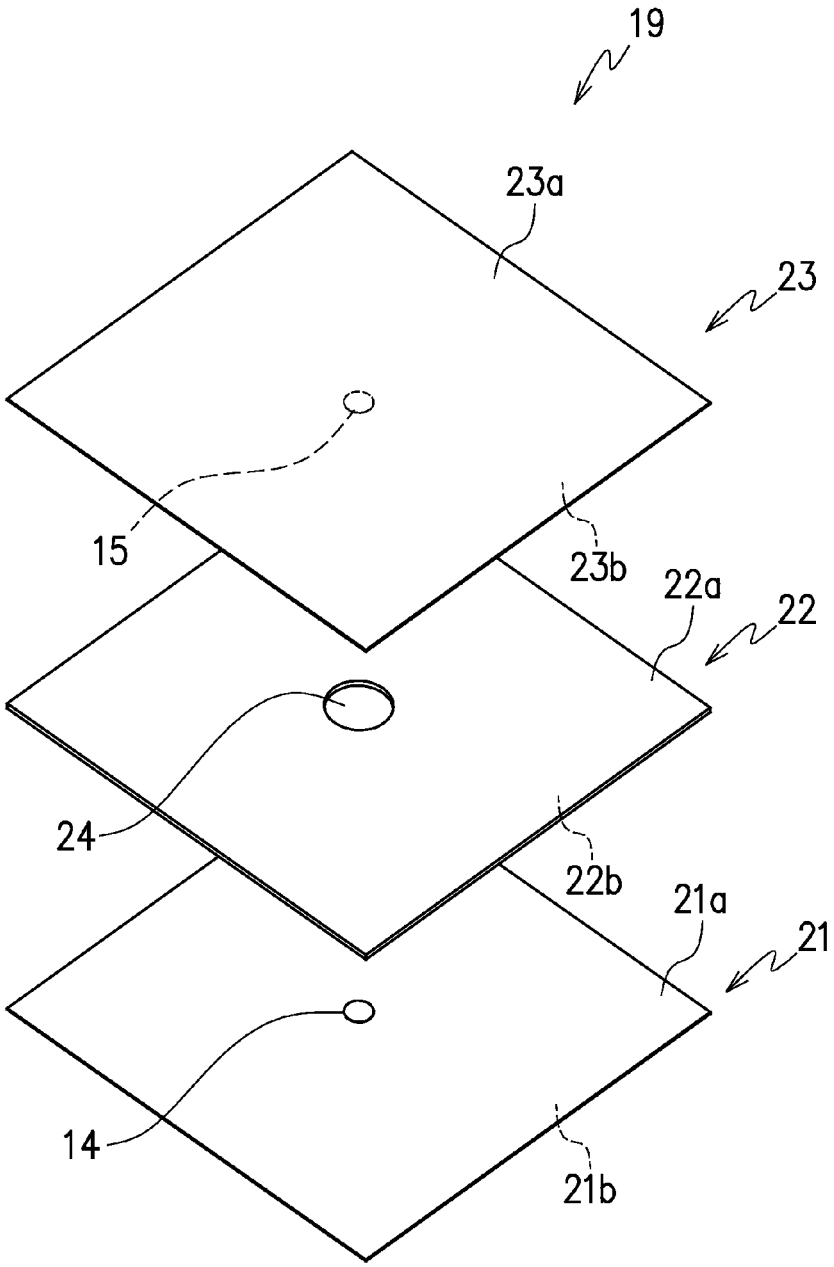
FIG. 1J is an exploded perspective view of a film including a first layer with an upper electrode, a second layer with a hole, and a third layer with a lower electrode.

As in FIG. 1J, the spring plate 100 including the strip 12 that is arranged above the second electrode 15 of the film 19. The film 19 includes the first layer 21 that includes the upper surface 21*a* and a the lower surface 21*b* opposite to the upper surface 21*a*, the second layer 22 that includes the upper surface 22*a* and the lower surface 22*b* opposite to the upper surface 22*a*, and the third layer 23 that includes the upper surface 23*a* and the lower surface 23*b* opposite to the upper surface 23*a*. The first layer 21 of the film 19 includes the first electrode 14 arranged on the upper surface 21*a* of the first layer 21. The second layer 22 of the film 19 includes the hole 24 passing through the second layer 22 from the upper surface 22*a* to the lower surface 22*b* of the second layer 22. The third layer 23 of the film 19 includes the second electrode 15 arranged on the lower surface 23*b* of the third layer 23. The second electrode 15 arranged on the lower surface 23*b* of the third layer 23 of the film 19, the hole 24 of the second layer 22 of the film 19, and the first electrode 14 arranged on the upper surface 21*a* of the first layer 21 are positioned below the central portion 1 of the spring plate 100.

The push switch 900 includes the film 19 including the first electrode 14 and the second electrode 15. The push switch 900 further includes the spring plate 100 that is arranged on the film 19. For more details, the spring plate 100 is arranged on the upper surface 23*a* of the third layer 23 of the film 19. In this embodiment, since the spring plate 100 is arranged on the film 19, when the push switch 900 is pressed down from above, the film 19 may be effective to absorb a collision noise of the spring plate 100, compared with a push switch in which a spring plate is arranged directly on a substrate.

The strip 12 of the spring plate 100 is configured to endure a first operating load that is greater than a second operating load which the film 19 is configured to endure.

The push switch 900 may further include a frame 120 that is arranged on the upper surface 23*a* of the film 19. The frame 120 may include an opening 160 passing through the frame 120 from an upper surface 120*a* to a lower surface 120*b*. The spring plate 100 may be arranged on the upper surface 23*a* of the film 19 in the opening 160 of the frame 120. The first electrode 14 and the second electrode 15 in the film may be positioned in the opening 160 under the strip 12 of the spring plate 100 in a plan view. The opening 160 of the frame 12 has a shape to house the spring plate 100.

A spring plate 200 according to a second embodiment of the present application will be described with reference to FIGS. 2A-2C.

The spring plate 200 includes a central portion 1; an opening 11 that is positioned at a center of the central portion 1; and a strip 12 extending from a part of an inner edge 11*a* of the opening 11 that is positioned at the center of the central portion 1 of the spring plate 200. The strip 12 includes a first width 12*a* that is positioned adjacent to the part of the inner edge 11*a* of the opening 11 and a second width 12*b* that is positioned adjacent to an end 12*c* of the strip 12. The first width 12*a* of the strip 12 is wider than the second width 12*b* that is positioned adjacent to the end 12*c* of the strip 12.

The first width 12*a* of the strip 12 may be in a range of one fourth to one third of a length of the inner edge 11*a* of the opening 11.

The spring plate 200 may be made of stainless, for example. The spring plate 200 may be made of alloy steel, nickel alloy, aluminum alloy, and/or titanium, for example.

The spring plate 200 may be cut out from a metal plate. The strip 12 includes a first shape that spreads toward the first width 12*a* from a position that is closer to the first width 12*a* than the end 12*c* of the strip 12. This configuration of the spring plate 200 enables to lessen stress that may be generated at a root of the strip 12 while a pressing force is being applied on the spring plate 200. The first width 12*a* is a width at the root of the strip 12.

The strip 12 further includes a second shape that is an elongated shape. The elongated shape is positioned closer to the end 12*c* of the strip 12 than the root with the first width 12*a* of the strip 12. In this embodiment, the end 12*c* of the strip 12 of the spring plate 200 is not connected to a part of the spring plate 200, and thus, the end 12*c* of the strip 12 is free.

In this embodiment, since the end 12*c* of the strip 12 of the spring plate 200 is free, a switch stroke would be secured even when a pressing force is being applied on the spring plate to an end position of the spring plate.

Figure 2A:
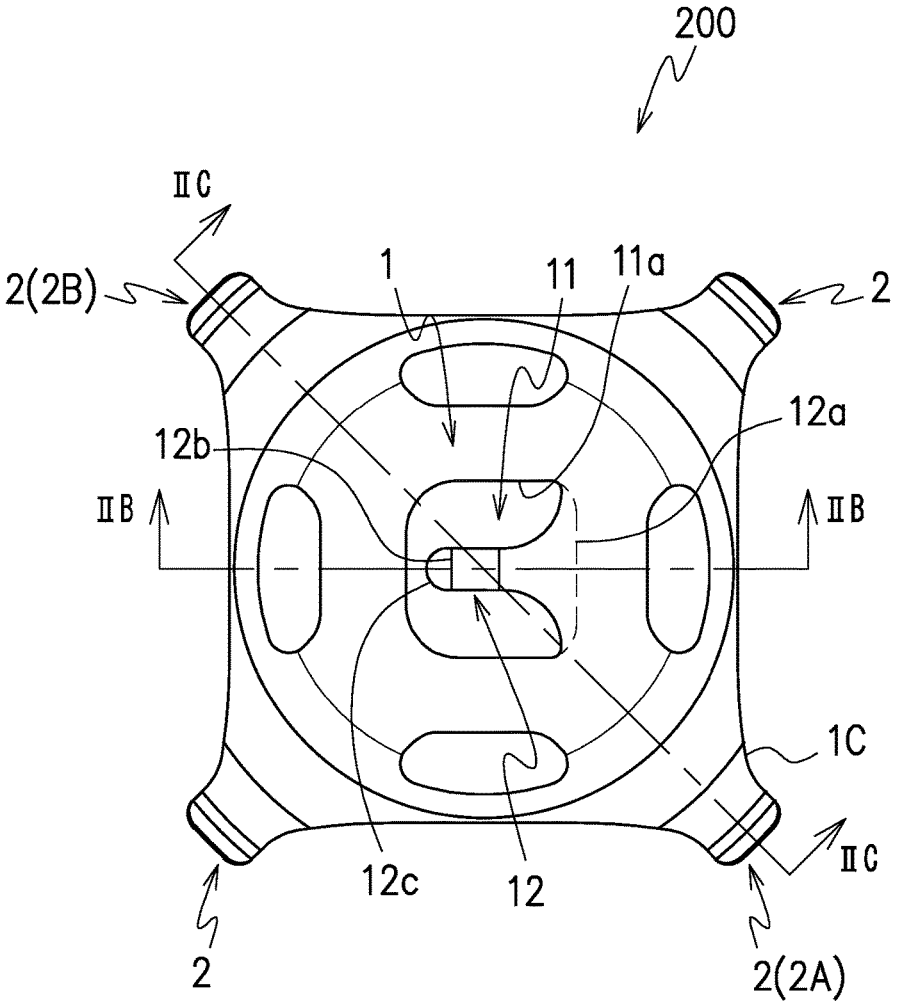
FIG. 2A is a top plan view of a spring plate according to a second embodiment of the subject matter.

The first shape of the strip 12 may curvedly spread toward the first width 12*a* of the strip 12 in a plan view as in FIG. 2A.

The spring plate 200 may further include a leg portion 2 projecting outward from an outer edge 1*c* of the central portion 1 of the spring plate 200. In this embodiment, the central portion 1 of the spring plate 200 may include a circular outline. For more details, in this embodiment, the spring plate 200 may include a first leg portion 2(2A) projecting outward from the outer edge 1*c* of the central portion 1. The spring plate 200 further may include a second leg portion 2 (2B) projecting outward from the outer edge 1*c* of the central portion 1. The first leg portion 2(2A) may be positioned with a space from the second leg portion 2(2B). The first leg portion 2(2A) may be positioned opposite to the second leg portion 2(2B).

As in FIG. 2A, the spring plate 200 may include four leg portions 2 positioned with a space to one another of the leg portions 2 around the central portion 1. The four leg portions 2 project outward and downward from the outer edge 1*c* of the central portion 1 of the spring plate 200.

Also, the central portion 1 of the spring plate 200 may include a convex shape around the opening 11. The central portion 1 of the spring plate 200 in this embodiment may appear to include a square shape in a plan view, as in FIG. 2A.

Figure 2B:
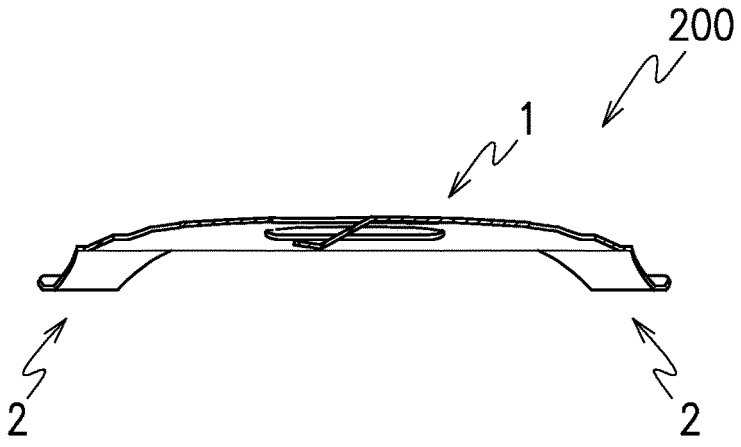
FIG. 2B is a cross-sectional view of a the spring plate, taken along a dotted line IIB of FIG. 2A.

FIG. 2B is a cross-sectional view of the spring plate 200, taken along a dotted line IIB of FIG. 2A.

Figure 2C:
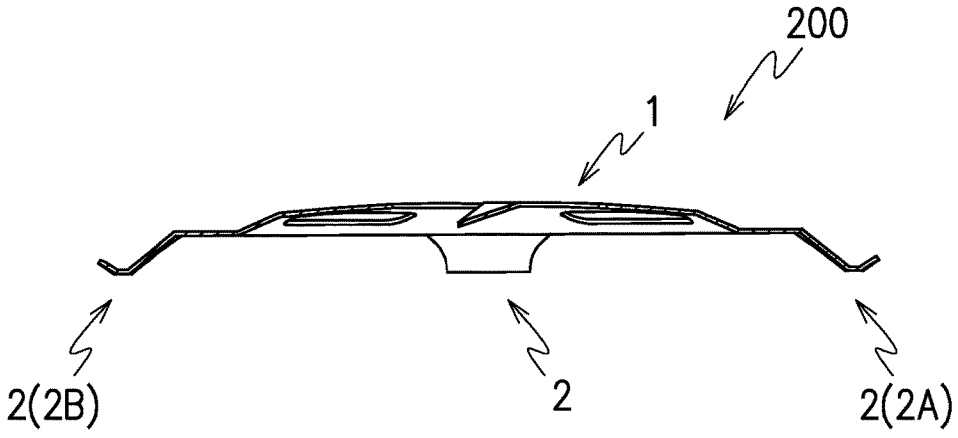
FIG. 2C is a cross-sectional view of the spring plate, taken along a dotted line IIC of FIG. 2A. The dotted line IIC is a second direction in FIG. 2A.

FIG. 2C is a cross-sectional view of the spring plate, taken along a dotted line IIC in a second direction shown in of FIG. 2A. The dotted line IIC is a second direction in FIG. 2A.

A spring plate 300 according to a third embodiment of the present application will be described with reference to FIGS. 3A-3C.

The spring plate 300 includes a central portion 1; an opening 11 that is positioned at a center of the central portion 1; and a strip 12 extending from a part of an inner edge 11*a* of the opening 11 that is positioned at the center of the central portion 1 of the spring plate 300. The strip 12 includes a first width 12*a* that is positioned adjacent to the part of the inner edge 11*a* of the opening 11 and a second width 12*b* that is positioned adjacent to an end 12*c* of the strip 12. The first width 12*a* of the strip 12 is wider than the second width 12*b* that is positioned adjacent to the end 12*c* of the strip 12.

The first width 12*a* of the strip 12 may be in a range of one fourth to one third of a length of the inner edge 11*a* of the opening 11.

Figure 3A:
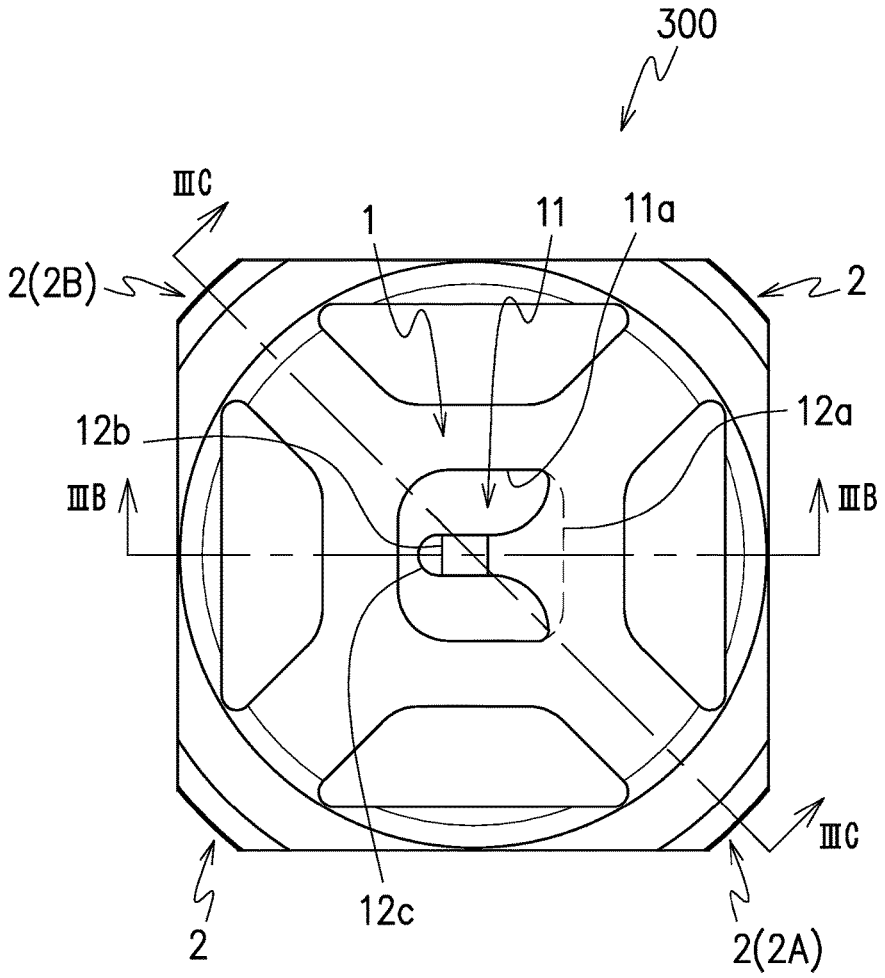
FIG. 3A is a top plan view of a spring plate according to a third embodiment of the subject matter.
Figure 3B:
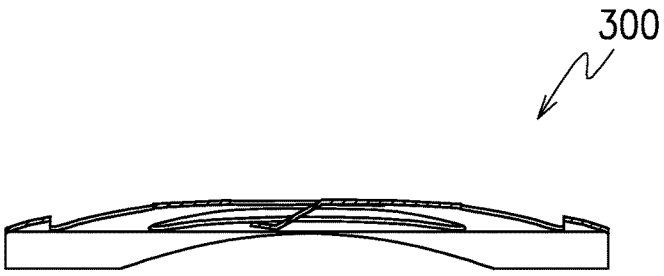
FIG. 3B is a cross-sectional view of the spring plate, taken along a dotted line IIIB of FIG. 3A.

FIG. 3B is a cross-sectional view of the spring plate 300, taken along a dotted line IIIB of FIG. 3A.

Figure 3C:
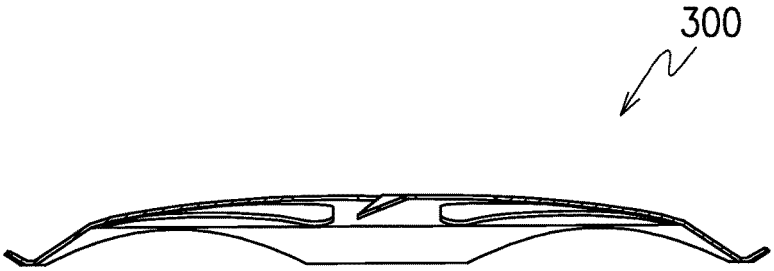
FIG. 3C is a cross-sectional view of the spring plate, taken along a dotted line IIIC of FIG. 3A.

FIG. 3C is a cross-sectional view of the spring plate 300, taken along a dotted line IIIC of FIG. 3A.

A spring plate 400 according to a fourth embodiment of the present application will be described with reference to FIGS. 4A-4C.

Figure 4A:
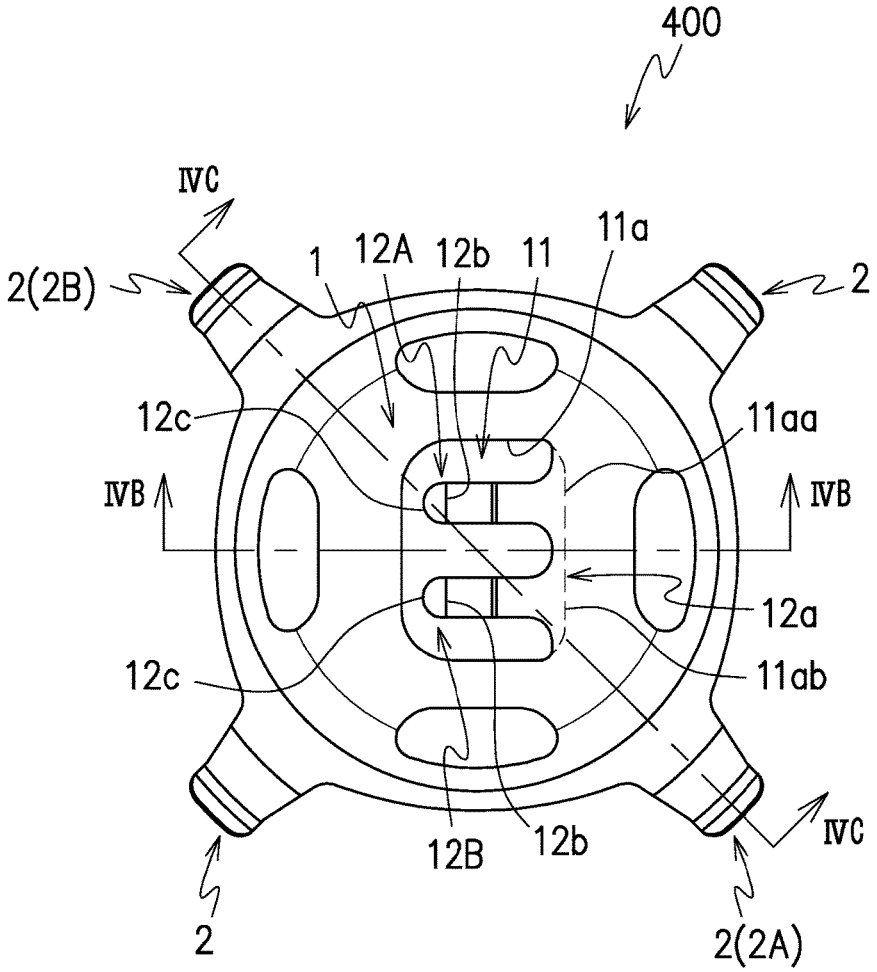
FIG. 4A is a top plan view of a spring plate according to a fourth embodiment of the subject matter.

As in FIG. 4A The spring plate 400 includes four leg portions 2.

Figure 4B:
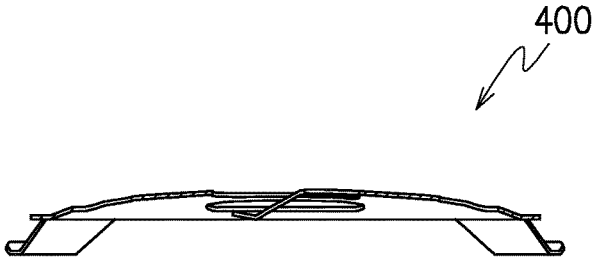
FIG. 4B is a cross-sectional view of the spring plate, taken along a dotted line IVB of FIG. 4A.

FIG. 4B is a cross-sectional view of the spring plate 400, taken along a dotted line IVB of FIG. 4A.

Figure 4C:
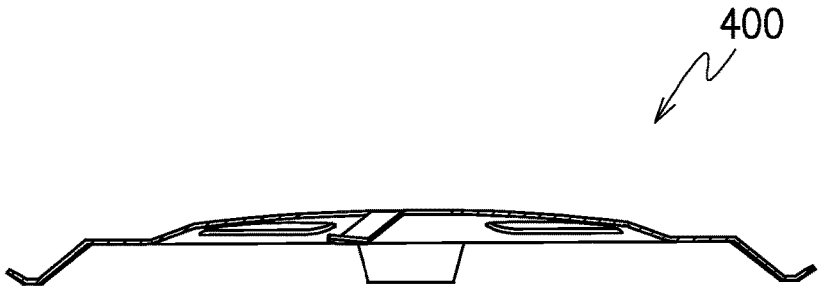
FIG. 4C is a cross-sectional view of the spring plate, taken along a dotted line IVC of FIG. 4A.

FIG. 4C is a cross-sectional view of the spring plate 400, taken along a dotted line IVC of FIG. 4A.

The spring plate 400 includes a central portion 1, an opening 11 that is positioned at a center of the central portion 1, a first strip 12A extending from a first part of an inner edge 11*a* of the opening 11 that is positioned at the center of the central portion 1, and a second strip 12B extending from a second part of the inner edge 11*a* of the opening 11 that is positioned at the center of the central portion 1. The first strip 12A includes a first width 12*a* that is positioned adjacent to the first part of the inner edge 11*a* of the opening 11 and a second width 12*b* that is positioned adjacent to an end 12*c* of the first strip 12A. The first width 12*a* of the first strip 12A is wider than the second width 12*b* that is positioned adjacent to the end 12*c* of the first strip 12A. The second strip 12B includes a first width 12*a* that is positioned adjacent to the second part of the inner edge 11*a* of the opening 11 and the second width 12*b* that is positioned adjacent to an end 12*c* of the second strip 12B. The first width 12*a* of the second strip 12B is wider than the second width 12*b* that is positioned adjacent to the end 12*c* of the second strip 12B. In this embodiment, since the spring plate 400 includes two strips 12A, 12B, operation load at the strips is dividable to the two strips 12A, 12B. Accordingly, this configuration is expected to extend a life-span of a spring plate. A first part 11*aa* and a second part 11*ab* of the inner edge 11*a* of the opening 11 are positioned at a first side of the opening 11.

A spring plate 500 according to a fifth embodiment of the present application will be described with reference to FIGS. 5A-5C.

Figure 5A:
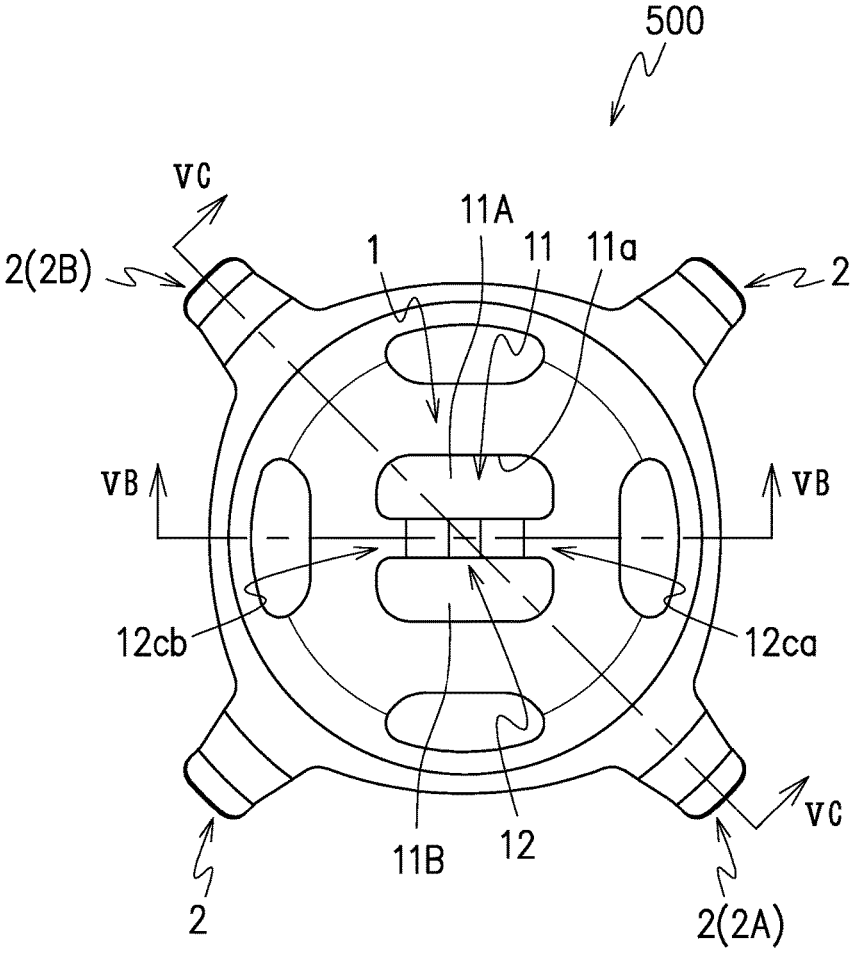
FIG. 5A is a top plan view of a spring plate according to a fifth embodiment of the subject matter.

As in FIG. 5A, the spring plate 500 includes a central portion 1, an opening 11 that is positioned at a center of the central portion 1, and a strip 12 including a first end 12*ca* that is connected to a first part of an inner edge 11*a* of the opening 11 and a second end 12*cb* that is connected to a second part of the inner edge 11*a* of the opening 11. The strip 12 crossing the opening 11 is configured to divide the opening 11 into two openings 11A, 11B.

The first end 12*ca* of the strip 12 is positioned opposite to the second end 12*cb* of the strip 12. The strip 12 further includes a center portion 12*a* that is positioned lower than the inner edge 11*a* of the opening 11.

Figure 5B:
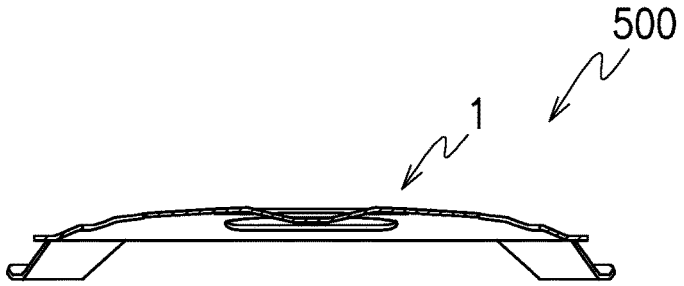
FIG. 5B is a cross-sectional view of the spring plate, taken along a dotted line VB of FIG. 5A.

FIG. 5B is a cross-sectional view of the spring plate 500, taken along a dotted line VB of FIG. 5A.

Figure 5C:
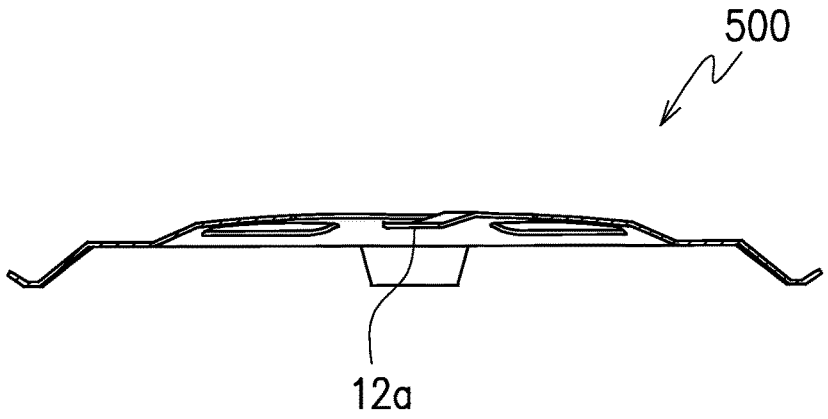
FIG. 5C is a cross-sectional view of the spring plate, taken along a dotted line VC of FIG. 5A.

FIG. 5C is a cross-sectional view of the spring plate 500, taken along a dotted line VC of FIG. 5A.

A spring plate 600 according to a sixth embodiment of the present application will be described with reference to FIGS. 6A-6C.

In this embodiment, the spring plate 600 includes a central portion 1, an opening 11 that is positioned at a center of the central portion 1, a first strip 12A extending from a first part of an inner edge 11*a* of the opening 11 that is positioned at the center of the central portion 1 to an end of the first strip 12A, a second strip 12B extending from a second part of the inner edge 11*a* of the opening 11 that is positioned at the center of the central portion 1 to an end of the second strip 12B, and a third strip 12C extending from a third part of the inner edge 11*a* of the opening 11 that is positioned at the center of the central portion 1 to an end of the third strip 12C. The end of the first strip 12A, the end of the second strip 12B, and the end of the third strip 12C are positioned adjacent to the center of the opening 11 in a plan view, as in FIG. 6A. The end of the first strip 12A, the end of the second strip 12B, and the end of the third strip 12C are positioned lower than the inner edge 11*a* of the opening 11.

Figure 6A:
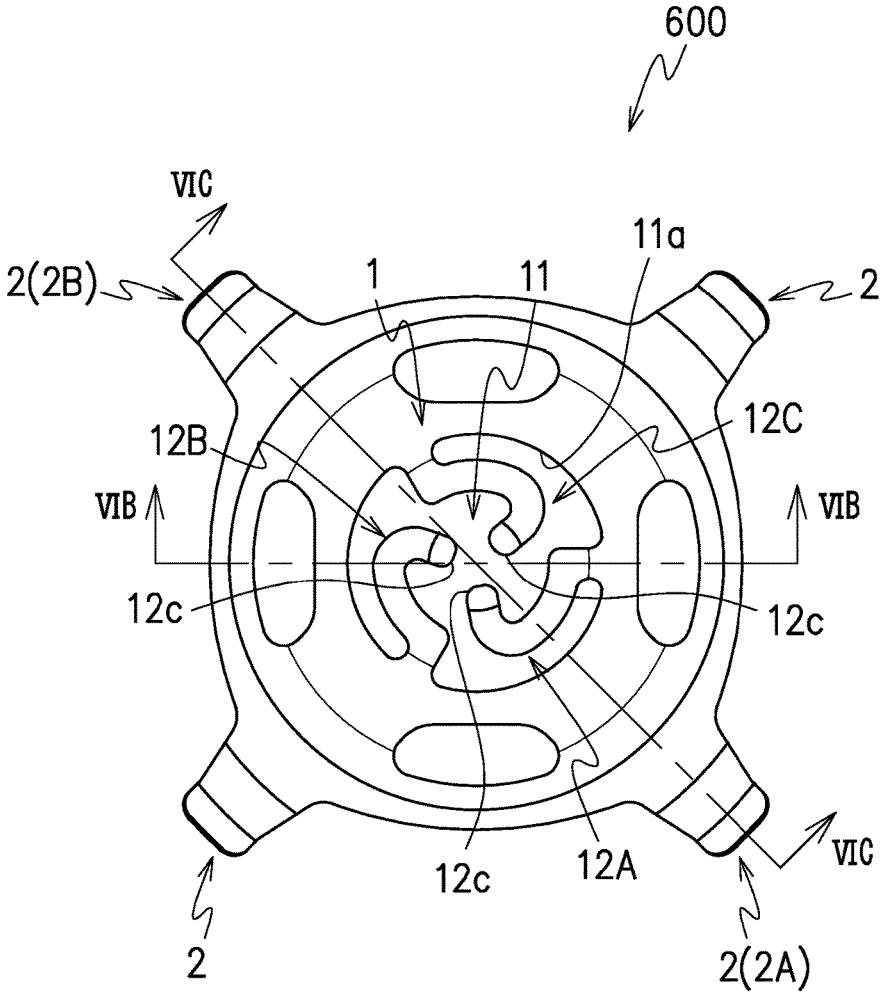
FIG. 6A is a top plan view of a spring plate according to a sixth embodiment of the subject matter.
Figure 6B:
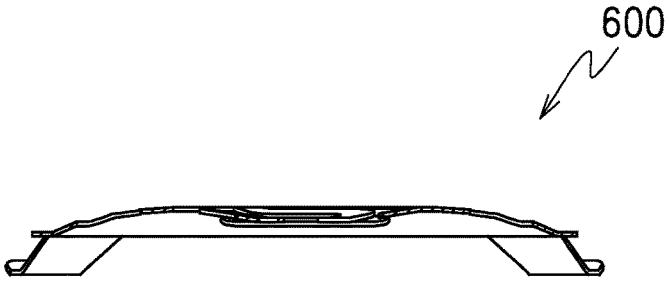
FIG. 6B is a cross-sectional view of the spring plate, taken along a dotted line VIB of FIG. 6A.

FIG. 6B is a cross-sectional view of the spring plate 600, taken along a dotted line VIB of FIG. 6A.

Figure 6C:
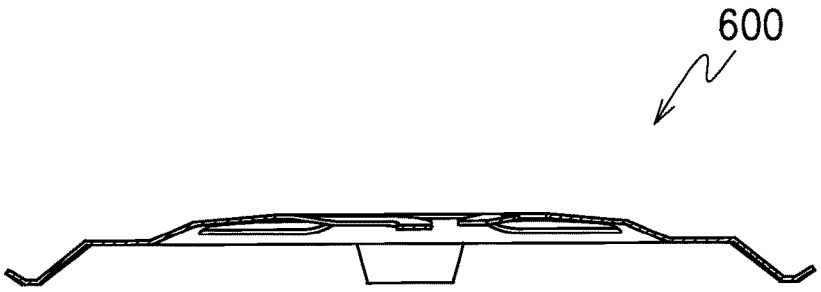
FIG. 6C is a cross-sectional view of the spring plate, taken along a dotted line VIC of FIG. 6A.

FIG. 6C is a cross-sectional view of the spring plate 600, taken along a dotted line VIC of FIG. 6A.

The first strip 12A includes a curving portion. The second strip 12B includes a curving portion, and the third strip 12C includes a curving portion.

A spring plate 700 according to a seventh embodiment of the present application will be described with reference to FIGS. 7A-7C.

In this embodiment, the spring plate 700 includes a central portion 1, an opening 11 that is positioned at a center of the central portion 1, a first strip 12A extending from a first part of an inner edge 11*a* of the opening 11 that is positioned at the center of the central portion 1 to an end of the first strip 12A, a second strip 12B extending from a second part of the inner edge 11*a* of the opening 11 that is positioned at the center of the central portion 1 to an end of the second strip 12B, and a third strip 12C extending from a third part of the inner edge 11*a* of the opening 11 that is positioned at the center of the central portion 1 to an end of the third strip 12C. The end of the first strip 12A, the end of the second strip 12B, and the end of the third strip 12C are positioned adjacent to a center of the opening 11 in a plan view. The end of the first strip 12A, the end of the second strip 12B, and the end of the third strip 12C are positioned lower than the inner edge 11*a* of the opening 11. In this embodiment, the spring plate 700 further includes a central connection 13 that is positioned at the center of the opening 11 in a plan view, as in FIG. 7A. The central connection 13 is positioned lower than the inner edge 11*a* of the opening 11. The end of the first strip 12A, the end of the second strip 12B and the end of the third strip 12C are connected to the central connection 13 of the spring plate 700.

Figure 7A:
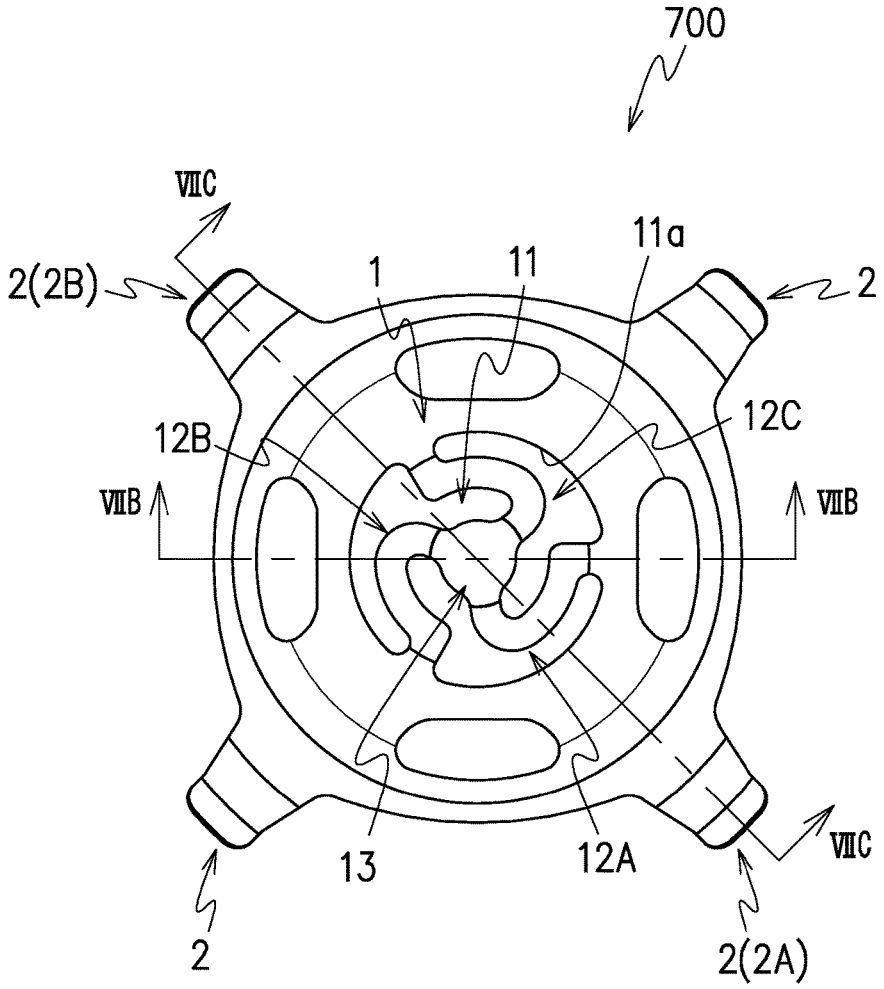
FIG. 7A is a top plan view of a spring plate according to a seventh embodiment of the subject matter.
Figure 7B:
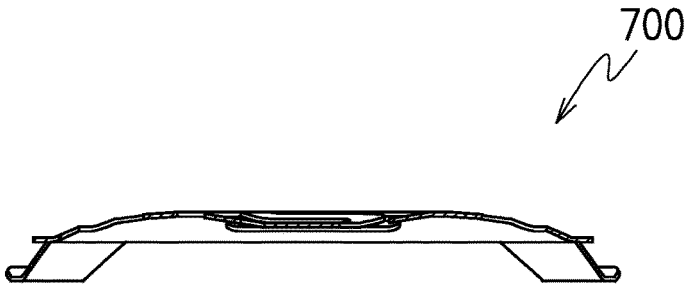
FIG. 7B is a cross-sectional view of the spring plate, taken along a dotted line VIIB of FIG. 7A.

FIG. 7B is a cross-sectional view of the spring plate 700, taken along a dotted line VIIB of FIG. 7A.

Figure 7C:
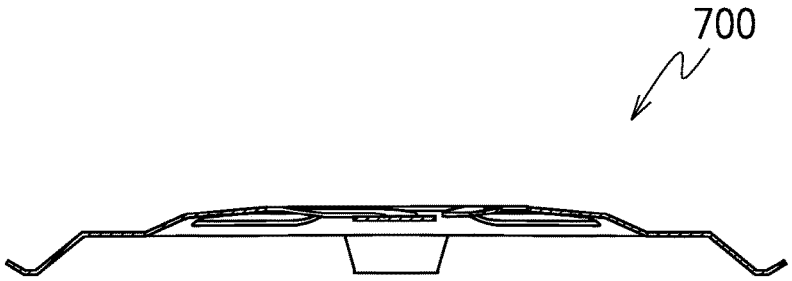
FIG. 7C is a cross-sectional view of the spring plate, taken along a dotted line VIIC of FIG. 7A.

FIG. 7C is a cross-sectional view of the spring plate 700, taken along a dotted line VIIC of FIG. 7A.

The push switch according to the subject matter herein may be arranged horizontally and/or vertically in and/or on an electronic device.

Various electronic devices include push switches. An electronic device includes the push switch according to an embodiment of the subject matter, and a motherboard includes a first electrode and a second electrode. The push switch may be electrically connected to the first electrode and the second electrode of the motherboard of the electronic device.

Furthermore, while certain embodiments of the present inventive subject matter have been illustrated with reference to specific combinations of elements, various other combinations may also be provided without departing from the teachings of the present inventive subject matter. Thus, the present inventive subject matter should not be construed as being limited to the particular exemplary embodiments described herein and illustrated in the Figures, but may also encompass combinations of elements of the various illustrated embodiments.

Many alterations and modifications may be made by those having ordinary skill in the art, given the benefit of the present disclosure, without departing from the spirit and scope of the inventive subject matter. Therefore, it must be understood that the illustrated embodiments have been set forth only for the purposes of example, and that it should not be taken as limiting the inventive subject matter as defined by the following claims. The following claims are, therefore, to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the inventive subject matter.

What is claimed is:

1. A spring plate comprising:

a central portion;

an opening having a rectangular shape and being positioned at a center of the central portion, the opening comprising an inner edge; and a single strip extending from a part of the inner edge of the opening, wherein the single strip comprises:

a first width that is positioned adjacent to the part of the inner edge of the opening; and a second width that is positioned adjacent to an end of the single strip, the first width of the single strip is wider than the second width of the single strip, the single strip comprises a first shape that becomes gradually wider with gentle curves toward the first width from a position that is closer to the first width than the end of the single strip, the single strip comprises a second shape having an elongated shape including the second width of the single strip, and is positioned closer to the end of the single strip than the first width of the single strip, and a part of the single strip adjacent to the end of the single strip is positioned lower than the inner edge of the opening.

2. The spring plate according to claim 1, wherein the first width of the single strip is in a range of one fourth to one third of a length of the inner edge of the opening.

3. The spring plate according to claim 1, further comprising:

a leg portion projecting outward from an outer edge of the central portion.

4. The spring plate according to claim 1, wherein the central portion comprises a convex shape around the opening.

5. The spring plate according to claim 1, wherein the single strip of the spring plate is configured to endure an operating load that is 60 gf/mm or more.

6. The spring plate according to claim 1, wherein the single strip of the spring plate is configured to endure an operating load that is in a range of 60 gf/mm or more to 400 gf/mm or less.

7. A push switch comprising:

a film includes a first electrode and a second electrode; and a spring plate of claim 1 arranged on the film, wherein the single strip of the spring plate is configured to endure a first operating load that is greater than a second operating load which the film is configured to endure.

8. A spring plate comprising:

a central portion;

an opening having a rectangular shape and being positioned at a center of the central portion, the opening comprising an inner edge; and consisting of two strips including a first strip extending from a first part of the inner edge of the opening and a second strip extending from a second part of the inner edge of the opening, wherein the first strip comprises a first width that is positioned adjacent to the first part of the inner edge of the opening, and a second width that is positioned adjacent to an end of the first strip, the first width of the first strip is wider than the second width of the first strip, the first strip further comprises a part adjacent to the end of the first strip positioned lower than the inner edge of the opening, the second strip comprises a first width that is positioned adjacent to the second part of the inner edge of the opening, and a second width that is positioned adjacent to an end of the second strip, the first width of the second strip is wider than the second width, the second strip further comprises a part adjacent to the end of the second strip positioned lower than the inner edge of the opening, and the first strip and the second strip have a substantially identical shape, and are positioned parallel each other.

9. The spring plate according to claim 8, wherein the first part and the second part of the inner edge of the opening are positioned at a first side of the opening.

10. A spring plate comprising:

a central portion;

an opening having a rectangular shape and being positioned at a center of the central portion, the opening comprising an inner edge; and a strip comprising a first end and a second end, wherein the first end is connected to a first part of the inner edge of the opening, and the second end is connected to a second part of the inner edge of the opening, the first end and the second end being positioned opposite to each other, the strip crosses the opening to divide the opening into two openings, and the strip further comprises a center portion permanently positioned lower than the inner edge of the opening.

11. A spring plate comprising:

a central portion;

an opening that is positioned at a center of the central portion;

a first strip extending from a first part of an inner edge of the opening that is positioned at the center of the central portion to an end of the first strip;

a second strip extending from a second part of the inner edge of the opening that is positioned at the center of the central portion to an end of the second strip; and a third strip extending from a third part of the inner edge of the opening that is positioned at the center of the central portion to an end of the third strip, wherein the end of the first strip, the end of the second strip, and the end of the third strip are positioned adjacent to a center of the opening in plan view, and positioned lower than the inner edge of the opening.

12. The spring plate according to claim 11, wherein the first strip comprises a curving portion, the second strip comprises a curving portion, and the third strip comprises a curving portion.

13. The spring plate according to claim 11, further comprising:

a central connection that is positioned at the center of the opening in plan view and positioned lower than the inner edge of the opening, wherein the end of the first strip, the end of the second strip and the end of the third strip are connected to the central connection.

* * * * *